United States Patent [19]

Müller

[11] Patent Number: 4,823,691

[45] Date of Patent: Apr. 25, 1989

[54] SELF-INKING STAMP FOR PERFORMING AN INKING UPSTROKE

[75] Inventor: Klaus Müller, Österreich, Austria

[73] Assignee: Walter Just Gesellschaft m.b.H., Wels, Australia

[21] Appl. No.: 166,686

[22] Filed: Mar. 11, 1988

[30] Foreign Application Priority Data

Mar. 25, 1987 [AT] Austria ..... A716/87

[51] Int. Cl.[4] ..... B41J 27/00

[52] U.S. Cl. ..... 101/104; 101/334; 101/405

[58] Field of Search ..... 101/104, 105, 333, 334, 101/405

[56] References Cited

U.S. PATENT DOCUMENTS

| | | | |
|---|---|---|---|
| 438,179 | 10/1890 | Quaine | 101/104 |
| 1,670,735 | 5/1928 | Mortensen | 101/104 |
| 3,090,305 | 5/1963 | Keck | 101/105 X |

FOREIGN PATENT DOCUMENTS

| | | | |
|---|---|---|---|
| 379552 | 1/1986 | Australia | 101/405 |
| 1037313 | 8/1978 | Canada | 101/104 |
| 295185 | 1/1916 | Fed. Rep. of Germany | 101/105 |
| 410368 | 3/1925 | Fed. Rep. of Germany | 101/333 |
| 2220992 | 2/1978 | Fed. Rep. of Germany | 101/104 |
| 5986 | 5/1897 | Norway | 101/334 |

*Primary Examiner*—Edgar S. Burr
*Assistant Examiner*—James R. McDaniel
*Attorney, Agent, or Firm*—Kurt Kelman

[57] ABSTRACT

A self-inking stamp comprises a base part (1), which contains an ink pad (2) that is opposite to the bottom surface of the base part, a stamp insert, which carries a printing plate (9) and is reciprocable between the ink pad (2) and the bottom surface and is adapted to be inserted at the same time, and an actuating member (3), which has two end legs (4), which are guided on the outside of the end walls (5) of the base part. The actuating member is displaceable toward the bottom surface of the base part against spring force. The ends of a pivot (10) of the stamp insert are movably mounted in the end legs (4) of the actuating member (3) and may be movably mounted in said end legs in slots which extend transversely to the direction in which the actuating member is displaceable. The stamp insert is provided at its ends with longitudinal tracks (14) for receiving respective guide pins (13). The pivot (10) extends through cam slots (12), which are formed in the end walls (5) of the base part, which end walls (5) carry also the guide pins (13). Alternatively, said cam slots (12) are formed in plates (16), which are pivoted to the end walls (5) of the base part (1) and carry the guide pins (13). In order to reduce the stamping stroke, the stamp insert consists of at least two insert members (8), which carry respective printing plate parts (9) and are operable jointly and at the same time. Each insert member (8) cooperates with individually associated camming means (10 to 16) for imparting the inverting movement to that insert member.

4 Claims, 5 Drawing Sheets

SELF-INKING STAMP FOR PERFORMING AN INKING UPSTROKE

BACKGROUND OF THE INVENTION

1. Field of the Invention

This invention relates to a self-inking stamp for performing an inking upstroke, which stamp comprises a base part, which is adapted to be placed on the surface to be stamped and contains an ink pad, which is opposite to the bottom surface of the base part, a stamp insert, which is disposed in the base part and is adapted to be reciprocated between the ink pad and said bottom surface and to be inverted at the same time and carries a printing plate, and an actuating member, which has two end legs, which extend at opposite ends of the base part and are guided on the outside of the end walls of the base part, which actuating member is displaceable toward the bottom surface against spring force, the ends of a pivot of the stamp insert are movably mounted in said end legs, optionally in slots which extend transversely to the direction in which the actuating member is displaceable, said stamp insert is provided with laterally disposed, longitudinal tracks for receiving respective guide pins, said pivot extends through cam slots, which are formed in the end walls of the base part, which end walls carry the guide pins, or said cam slots are formed in pivoted plates, which are secured to said end walls and carry said guide pins.

2. Description of the Prior Art

Self-inking stamps of that kind, in which the ends of the pivot of the stamp insert are movably mounted in slots, which are formed in the end of said actuating member and extend transversely to the direction in which the actuating member is displaceable, and in which the cam slots cooperating with the pivot of the stamp insert are directly formed in the end walls of the base part, which end walls are also provided with the guide pins, are known, e.g., from Austrian Patent Specification No. 379,552 and the corresponding U.S. Pat. No. 4,603,628. In practice a modification of such self-inking stamps is known, in which the pivot is held in the end legs of the actuating member without a lateral play and extends through the end walls of the base part in a simple longitudinal slot, which extends in the direction in which the actuating member is displaceable. In order to invert the stamp insert during the stamping movement, pivoted plates are secured to the inside of the end walls of the base part and are formed with the cam slots cooperating with the pivot of the stamp inset and carry the guide pins.

The type on the printing plate is usually so arranged that the letters or numerals or other characters are oriented at right angles to the pivot of the stamp insert so that words or lines of type are parallel to said pivot. But it is often desired to provide a substantial amount of type on the printing plate even though the printing plate should not have an excessive length in the direction of said pivot so that the line length is restricted. In that case it will be necessary to provide a plurality of lines arranged one under the other and the printing plate must have a substantial dimension in the direction which is transverse to the pivot. But it will be appreciated that the stamping stroke, i.e., the displacement of the actuating member between the positions corresponding to the two end positions of the printing plate, will substantially depend on the dimension of the printing plate in the direction which is transverse to the pivot because a pivot for the inversion of a narrow printing plate may be disposed nearer to the ink pad and to the bottom surface than a pivot for the inversion of a wide printing plate, the longitudinal edges of which are spaced a correspondingly larger distance from said pivot. This means that an increase of the width of the printing plate measured transversely to said pivot will result in a considerable increase of the stamping stroke which is required and a stamp comprising a relatively wide printing plate will have a relatively large height and will be unhandy and can hardly be designed for a pleasing appearance.

SUMMARY OF THE INVENTION

For this reason it is an object of the invention to eliminate the disadvantages outlined hereinbefore and to provide a self-inking stamp which is of the kind described first hereinbefore and which is provided with type on a wide area, i.e., usually in a plurality of lines, and nevertheless does not require an excessively large stamping stroke so that the stamp may be designed with a relatively low height and may be handy.

That object is accomplished in accordance with the invention in that the stamp insert comprises at least two insert members, which carry respective printing plate parts, each insert member is provided with a separate pivot and at opposite ends with longitudinal tracks, each end wall of the base part is provided for each insert member with a cam slot and with a guide pin or with a pivoted plate provided with cam slot and a guide pin, and the end legs of the actuating member are optionally formed with slots equal in number to the insert members so that the insert members can be actuated jointly and at the same time.

The stamp insert is divided into at least two insert members and that division is such that the parting plane is parallel to the axle and preferably constitutes a plane of symmetry between the axles, and the printing plate parts abut each other. The means for guiding and inverting the insert members are similar to those used in the previous design but are provided in a number that corresponds to the number of the insert members. But it is not necessary to reciprocate and invert a large or wide printing plate, and owing to the division of the printing plate that movement is performed by narrow printing plate parts so that the stamping stroke can be much shorter and the entire stamp can be designed with a lower height. The stamp can easily be actuated, as before, because the insert members are actuated jointly and at the same time. The printing plate parts are disposed one beside the other or one below the other as they contact the joint ink pad and when they have been inverted jointly provide the stamp image, from which the division of the printing plate will not be apparent if that division has properly been chosen.

DETAILED DESCRIPTION OF THE PREFERRED EMBODIMENTS

Figure 1:
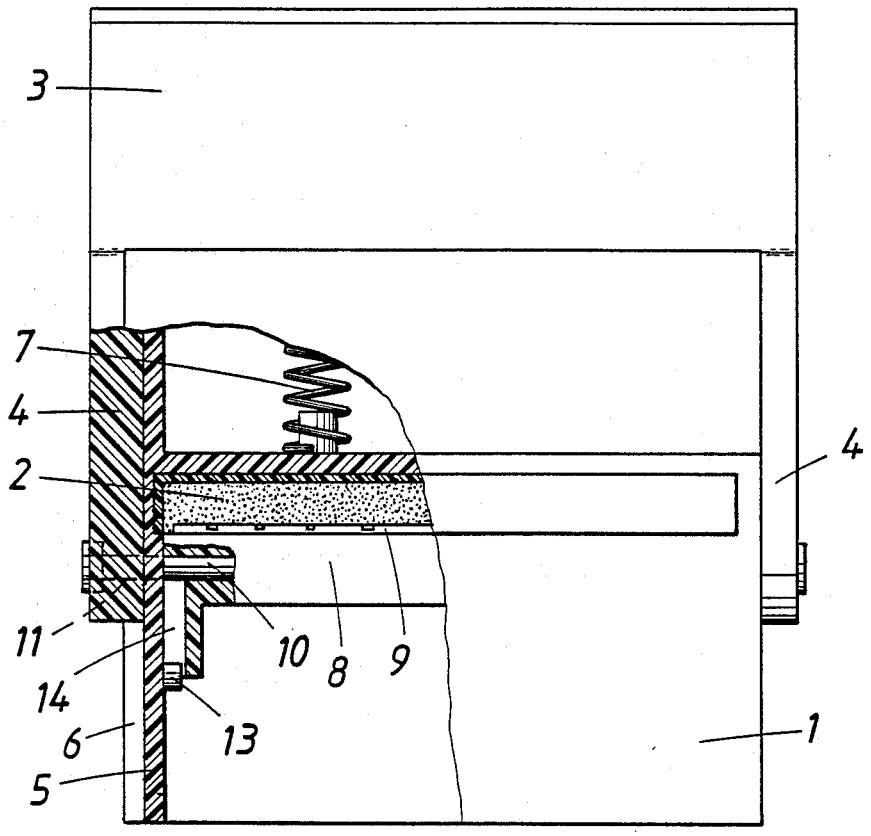
FIG. 1 is an elevation showing a self-inking stamp partly in a sectional view taken on line I—I in FIG. 2.

Illustrative embodiments of the invention will now be explained more in detail with reference to the drawing.

Figure 2:
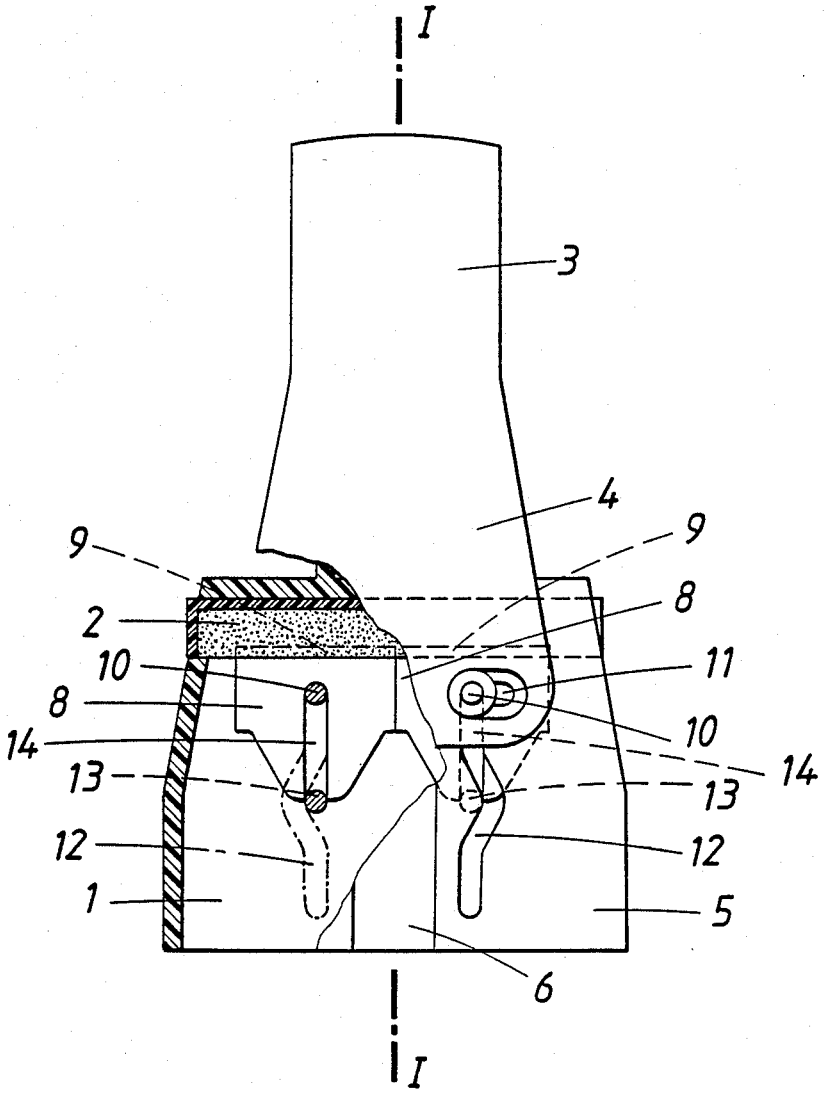
FIG. 2 is a side elevation showing the self-inking stamp of FIG. 1, partly broken away.
Figure 3:
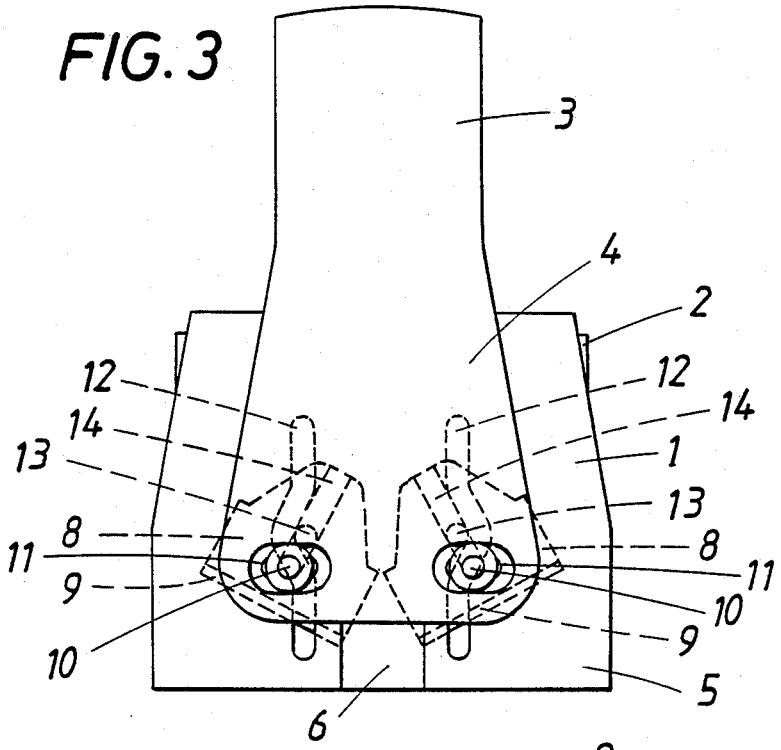
FIG. 3 is a side elevation showing the self-inking stamp of FIGS. 1 and 2 during the inversion of the two insert members.
Figure 4:
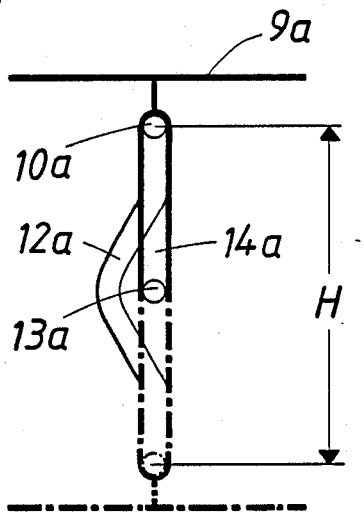
FIG. 4 is a diagrammatic view showing the camming means for controlling the inversion of the stamp insert in a stamp having an undivided stamp insert and an undivided printing plate.

The self-inking stamp shown in FIGS. 1 to 3 comprises a base part 1, which is made of plastic and has a bottom surface which is adapted to be placed on the surface to be stamped. The base part 1 contains an ink pad 2, which is spaced above the bottom surface of the base part. The self-inking stamp also comprises an actuating member 3, which has end legs 4, which are guided in respective grooves 6 formed in respective end walls 5 of the base part 1. The actuating member 3 can be displaced toward the bottom surface of the base part 1 against the force of two compression springs 7.

The base part 1 surrounds a stamp insert. In accordance with the invention that stamp insert consists of two identical insert members 8, which carry respective printing plate parts 9, which together form the entire stamp image. Each insert member 8 is provided with a pivot 10, about which the insert member can be inverted. The ends of the pivot 10 are movably mounted in slots 11, which extend transversely to the direction in which the actuating member 3 is displaceable. Each end wall 5 is formed with cam slots 12, which cooperate with respective pivots 10. The end walls 5 carry guide pins 13, which extend into longitudinal tracks 14 provided on each insert member 8 at opposite ends thereof.

Because the insert members 8 are guided on the guide pins 13 and the pivots 10 are guided in the cam slots 12, the insert members will perform the desired pivotal movement as the actuating member 3 is depressed. This will become apparent upon a comparison of FIGS. 2 and 3. In a stamp in which the stamp insert is not divided into two insert members but consists of an integral insert member provided with a correspondingly larger printing plate 9*a*, and in which the same camming means 10*a*, 12*a*, 13*a* and 14*a* are provided, a much larger stamping stroke H will be performed.

Figure 5:
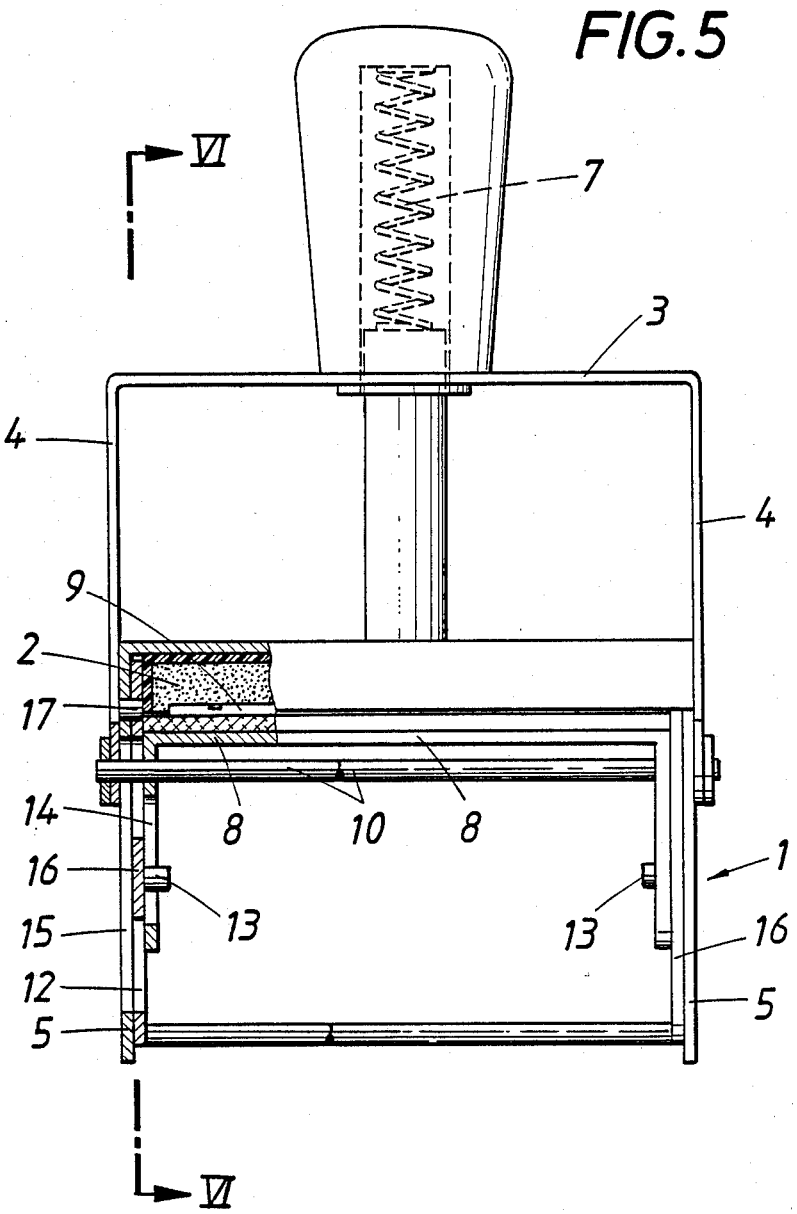
FIG. 5 shows a modification partly in a sectional view taken on line V—V in FIG. 6
Figure 6:
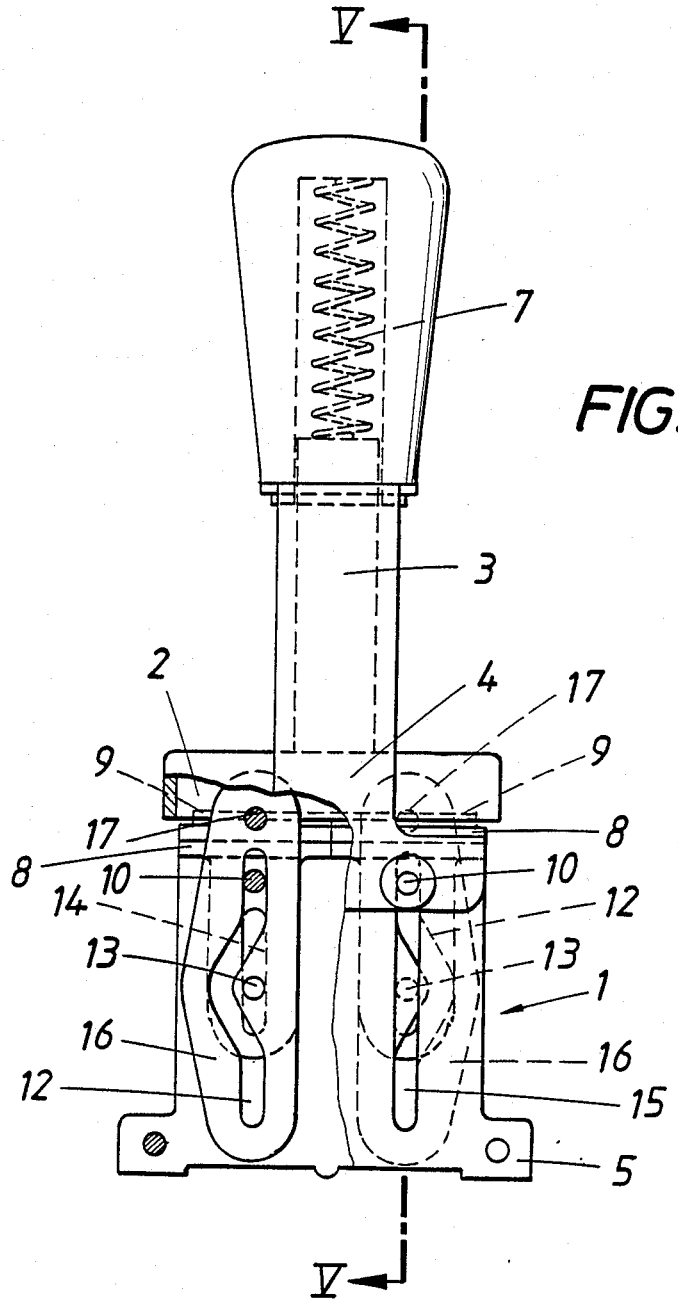
FIG. 6 is a side elevation partly broken away on line VI—VI in FIG. 5.

In the embodiment shown in FIGS. 5 and 6 the parts of the stamp are made of sheet metal. Elements having the same function are designated by the same reference characters as in FIGS. 1 to 3. The main difference from the plastic stamp resides in that the ends of the pivots 10 of the insert members 8 are movably mounted in the end legs 4 of the actuating member 3 in conventional round holes rather than in slots 11, the end walls 5 of the base part 1 are formed with slots 15, which extend in the direction in which the actuating member 3 is displaceable, and the pivots 10 extend through said slots 15. The cam slots 12 are formed in respective pivoted plates 16, each of which is mounted at its top on a pivot pin 17 and carries a guide pin 13, which extends into a longitudinal track 14 of an insert member 8. That embodiment has the same mode of operation as that of FIGS. 1 to 3.

I claim:

1. A self-inking stamp comprising (a) a single base part having two end walls and a bottom surface adapted to be placed on a surface to be stamped, (b) an ink pad contained in said base part and spaced above said bottom surface, (c) an actuating member having (2) two end legs guided by respective ones of said end walls, the actuating member being displaceable in a predetermined direction toward and away from said bottom surface, (d) spring means opposing the displacement of said actuating member toward said bottom surface, (e) a stamp insert means mounted in each of said end legs and in said base part between said ink pad and said bottom surface, the stamp insert means including (1) two insert members, (2) a respective printing plate part carried by each insert member, (3) a respective pivot carried by each insert member, and (4) a pair of longitudinal tracks formed at opposite sides of each insert member adjacent the end walls, (f) two pairs of cam slots, one pair associated with each insert member said pairs of cam slots being carried by said end walls, and cooperating with the pivot of the associated insert member, and (g) two pairs of guide pins, one pair associated with each insert member said pairs of guide pins being carried by said end walls, and cooperating with the longitudinal tracks formed in the associated insert member, (1) the longitudinal tracks, the pivots, the cam slots and the guide pins constituting camming means arranged to reciprocate the insert members jointly and at the same time between said ink pad and said bottom surface while inverting the insert members about the respective pivots thereof.

2. The self-inking stamp of claim 1, wherein the end legs are formed with two slots extending transversely to the direction of displacement of the actuating member and the pivots of the insert members are mounted in said slots.

3. The self-inking stamp of claim 1, wherein the cam slots are formed in the end walls and the guide pins are attached directly to the end walls of the base part.

4. The self-inking stamp of claim 1, further comprising plates pivoted to the end walls, the pivoted plates being formed with the cam slots and the guide pins being attached to the pivoted plates.

* * * * *

UNITED STATES PATENT AND TRADEMARK OFFICE

CERTIFICATE OF CORRECTION

PATENT NO. : 4,823,691

DATED : April 25, 1989

INVENTOR(S) : Klaus Muller

It is certified that error appears in the above-identified patent and that said Letters Patent is hereby corrected as shown below:

On the title page, Item [73] line 2, after "Wels" delete "Australia" and substitute therefor -- Austria --.

Signed and Sealed this

Thirtieth Day of January, 1990

*Attest:*

JEFFREY M. SAMUELS

*Attesting Officer*

*Acting Commissioner of Patents and Trademarks*